US005382004A

United States Patent [19]

Connors, Sr. et al.

[11] Patent Number: 5,382,004

[45] Date of Patent: Jan. 17, 1995

[54] TUNDISH SLAG STOPPER WITH SEALING RIM

[75] Inventors: Charles W. Connors, Sr., Wilmette; Madjid Soofi, St. Charles, both of Ill.

[73] Assignee: Magneco/Metrel, Inc., Addison, Ill.

[21] Appl. No.: 197,510

[22] Filed: Feb. 16, 1994

Related U.S. Application Data

[63] Continuation-in-part of Ser. No. 179,930, Jan. 11, 1994.

[51] Int. Cl.[6] ..... B22D 41/16

[52] U.S. Cl. ..... 266/230; 266/236; 266/275; 222/602

[58] Field of Search ..... 266/227, 229, 236, 271, 266/275, 230; 222/602, 597, 594

[56] References Cited

U.S. PATENT DOCUMENTS 3,028,642 4/1962 Stauffer ..... 222/602
3,934,755 1/1976 Rheinlander et al. ..... 266/230
4,368,834 1/1983 Daussan et al. ..... 222/602

*Primary Examiner*—Scott Kastler
*Attorney, Agent, or Firm*—Willian Brinks Hofer Gilson & Lione

[57] ABSTRACT

A slag stopper assembly for use in a tundish vessel includes a chamber for reducing the flow of slag to the tundish drain and a stopper plunger for regulating the flow of liquid metal through the drain. The chamber includes a central opening for receiving the stopper plunger, and the stopper plunger is retractably movable relative to the chamber through the central opening. In accordance with the invention, a sealing rim is present on the stopper plunger, or on an inner wall of the chamber, or both, in order to reduce the retractable movement of the stopper plunger, reduce the amount of slag which enters the chamber as a result of such movement, and seal off the central opening of the chamber from the tundish drain when the stopper plunger is in a retracted position.

26 Claims, 6 Drawing Sheets

TUNDISH SLAG STOPPER WITH SEALING RIM

RELATED APPLICATIONS

This application is a continuation-in-part of U.S. patent application Ser. No. 08/179,930 filed on Jan. 11, 1994, entitled "Apparatus And Method For Making Steel Alloys In A Tundish," the entire disclosure of which is incorporated herein by reference.

FIELD OF THE INVENTION

This invention is an improved tundish slag stopper assembly which prevents slag from entering the stopper chamber during movement of the plunger. The invention is particularly useful where the stopper chamber serves the additional function of an alloying chamber.

BACKGROUND OF THE INVENTION

Tundish slag stopper assemblies, including a slag stopper chamber generally above and surrounding the tundish drain and a piston driven stopper plunger penetrating the stopper chamber directly above the drain, are used in some tundishes for reducing slag and for stopping and starting the flow of liquid metal through the tundish drain. By way of background, a conventional tundish vessel 10, shown in FIG. 1, includes a floor 20, a front wall 12, a back wall 14, two side walls 16 and 18, an impact region 22, and a drain 24. An impact pad 26 having a sinusoidal upper surface helps reduce splashing and turbulence caused by pouring molten metal into the impact region 22. An upright baffle 28 helps regulate the flow of molten metal leaving the impact region 22 and proceeding toward the drain 24.

Referring to FIG. 2, the inside of the conventional tundish vessel 10 is lined with a refractory liner 11 adjacent to the outer steel shell 13. The drain 24 includes a drain nozzle 23, a refractory drain block or block assembly 25 above and surrounding the drain nozzle 23, and a layer of refractory binder or cement 27 between the drain block 25 and the nozzle 23. Flow of molten metal through the drain nozzle 23 is regulated using a stopper plunger 30. The stopper plunger 30, also shown in FIG. 8, includes an elongated piston 32 which can be raised and lowered by conventional techniques known in the art, and a wider drain stopper 34 connected to the piston 32.

Above and surrounding the drain block 25, and surrounding the stopper plunger 30, is a stopper chamber 40 used for keeping impurities known as "slag" from mixing with the molten metal which exits the drain 24. The stopper chamber 40, shown in FIGS. 2 and 6, includes a lower rim 42 surrounding the drain block 25, a center opening 44 for receiving and slidably engaging the piston 32, and a slanted, preferably conical or frustro-conical wall 46 between the rim 42 and the center opening 44. A plurality of smaller openings 48 for receiving molten metal are located in the slanted wall 46, preferably closer to the lower rim 42 than to the center opening 44. Because slag tends to float toward the top of the tundish, the amount of slag passing through the drain is minimized by allowing molten metal to enter the chamber 40 only through openings 48 located very near to the floor 20 of the tundish vessel.

The amount of space between the piston 32 and the inner wall 45 of the central opening 44 is just enough to permit the piston 32 to comfortably slide back and forth through the opening 44. When the drain is closed, the piston 32 is in a fully extended position as shown in FIG. 2. When the drain is open, the piston 32 has conventionally been in a fully retracted position as shown in FIG. 3. In other words, when the drain is open, the piston 32 has typically been raised until the wider drain stopper 34 comes into contact with the narrow top region of the slanted wall 46 of the chamber 40, as shown in FIG. 3.

In the conventional apparatus described above, some contamination of the molten metal leaving the tundish drain has resulted from the presence and operation of the stopper plunger 30. First, the space between the plunger piston 32 and the inner wall 45 of the center opening, though small, nevertheless permits some slag and lower purity molten metal to pass through the center opening 44 and into the chamber 40 due to suction from the drain. Second, the movement of the piston 32 between the fully retracted position shown in FIG. 3 and the fully extended position shown in FIG. 2 helps drag some of the impurities through the center opening 44. Third, wear and tear on the piston 30 and chamber 40 is facilitated by extensive movement of the piston 30, causing refractory contaminants to chip or erode away from these mechanical components.

SUMMARY OF THE INVENTION

The present invention is an improved slag stopper assembly which reduces the movement of the stopper plunger, reduces the wear and tear incurred by the plunger piston and the slag stopper chamber, reduces the amount of slag entering the chamber during movement of the piston, and restricts slag from entering the chamber through its center opening when the piston is less than fully retracted. A rim having a diameter wider than the diameter of the plunger piston is placed on the piston above the drain stopper. When the piston is retracted, the rim comes into contact with the slanted chamber wall before the drain stopper contacts the chamber wall. This causes the piston to stop in a position that is less than fully retracted, but which is sufficiently retracted to permit molten metal to flow freely through the drain.

A rim may alternatively be placed on the slanted wall of the chamber to contact the drain stopper and limit the retroactive movement of the piston. Alternatively, rims may be placed on both the piston and the chamber wall, which contact each other and limit the retractive movement of the piston. Any arrangement of rims is permissible as long as the result is to limit the retractive movement of the piston to a lesser extent than would occur if no rims were present.

With the foregoing in mind, it is a feature and advantage of the invention to provide a slag stopper assembly which reduces the retractive movement of the plunger piston, thereby reducing wear and tear on the plunger piston and slag stopper chamber.

It is also a feature and advantage of the invention to provide a slag stopper assembly which further reduces the amount of slag in the molten metal which exits the drain due to movement of the plunger piston.

It is also a feature and advantage of the invention to provide a slag stopper assembly which seals off the upper part of the slag stopper chamber, including its center opening, when the tundish drain is open.

It is also a feature and advantage of the invention to provide a tundish vessel which incorporates the improved slag stopper assembly of the invention.

The foregoing and other features and advantages of the invention will become further apparent from the following detailed description of the presently preferred embodiments, read in conjunction with the accompanying drawings. The detailed description and drawings are merely illustrative of the invention rather than limiting, with the scope of the invention defined by the appended claims and equivalents thereof.

DETAILED DESCRIPTION OF THE PRESENTLY PREFERRED EMBODIMENTS

Figure 1:
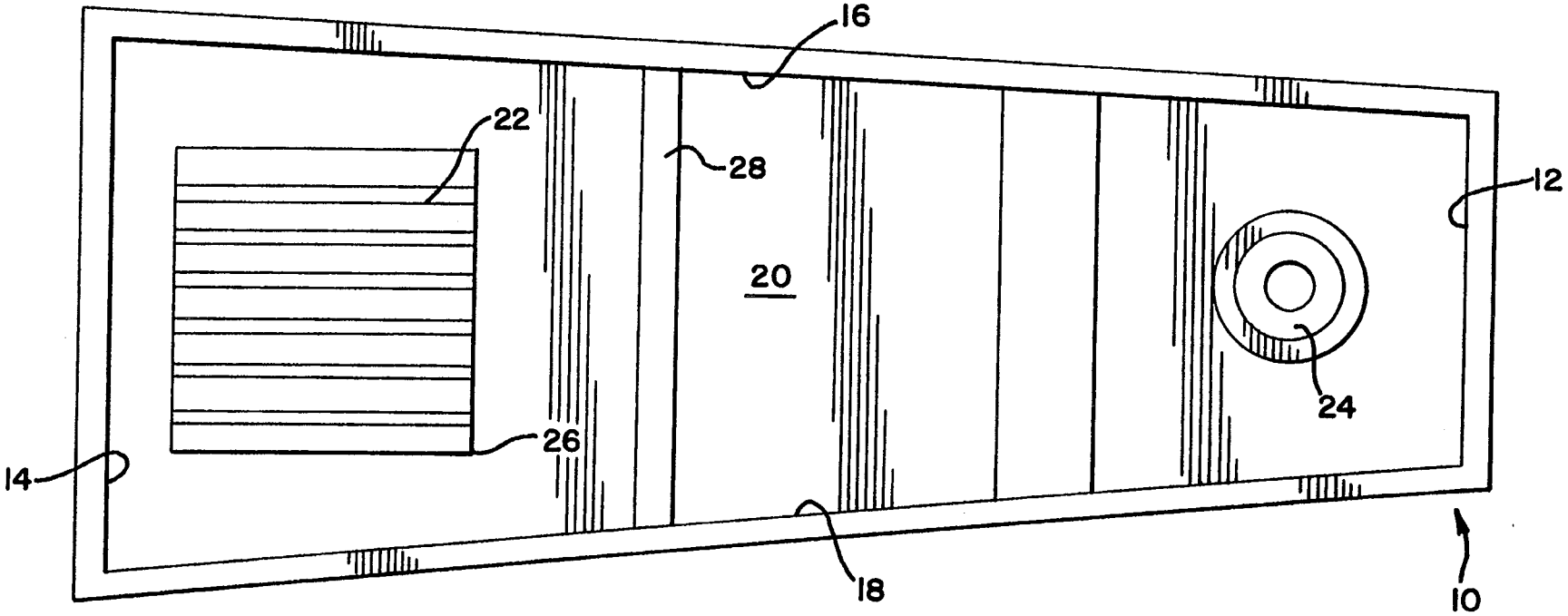
FIG. 1 is a top plan view of a conventional tundish vessel, without a slag stopper assembly above the drain.
Figure 3:
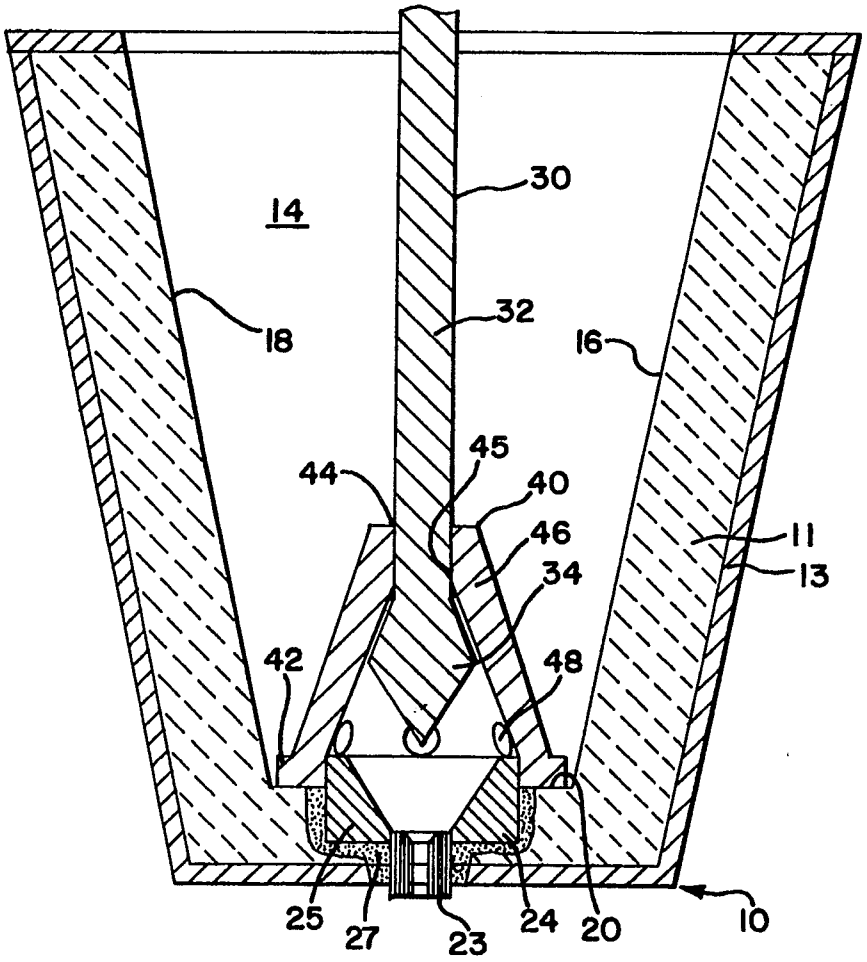
FIG. 3 corresponds to FIG. 2 except that the plunger piston is in the fully retracted (drain open) position.
Figure 2:
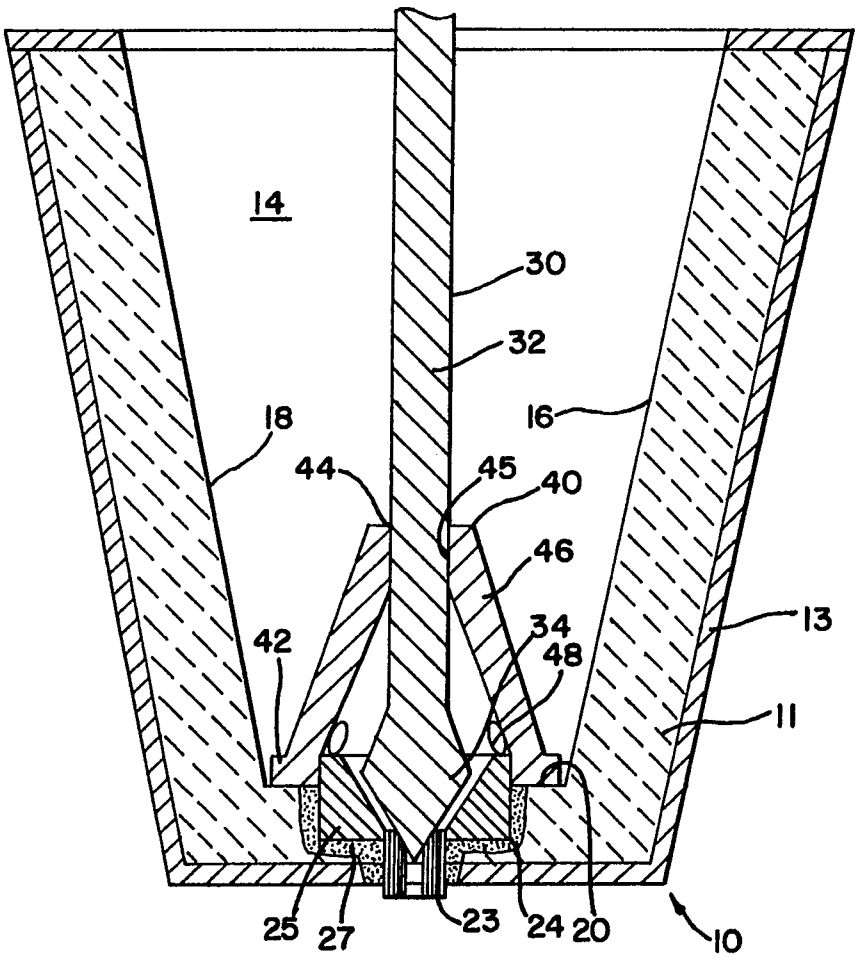
FIG. 2 is a front sectional view showing the drain region of the tundish vessel, further including a conventional slag stopper assembly with the plunger piston in the extended (drain closed) position.
Figure 4:
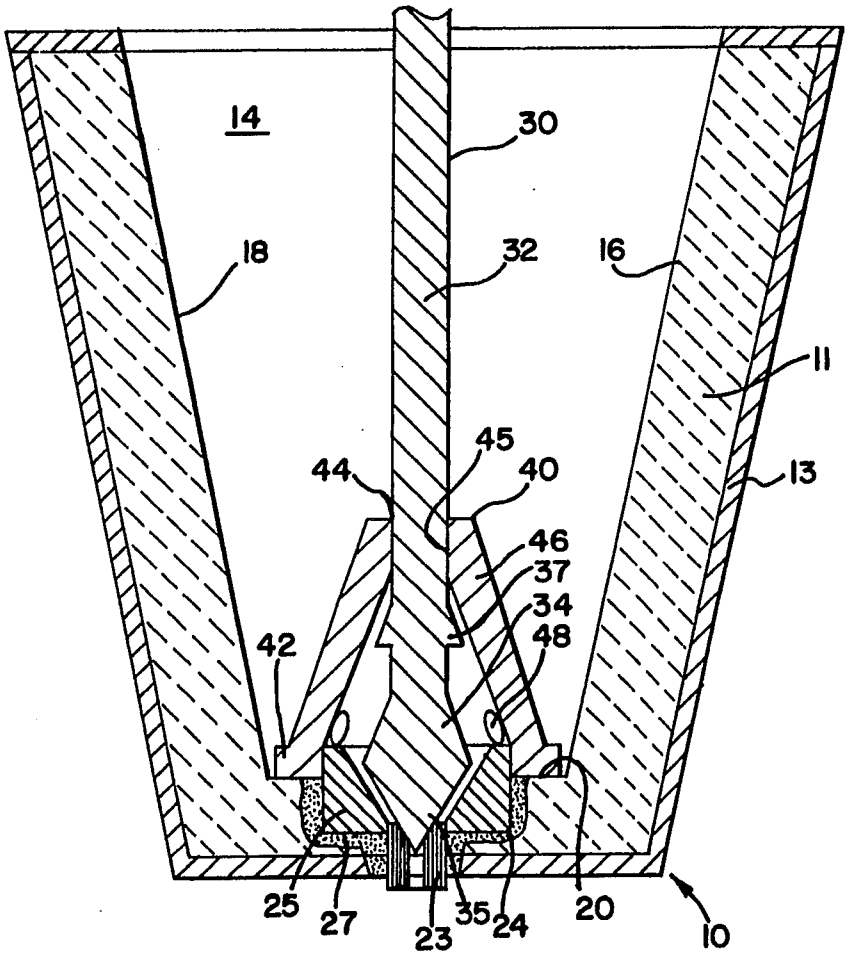
FIG. 4 corresponds to FIG. 2 except that the plunger piston has been modified to include a sealing rim above the drain stopper, in accordance with the invention.
Figure 6:
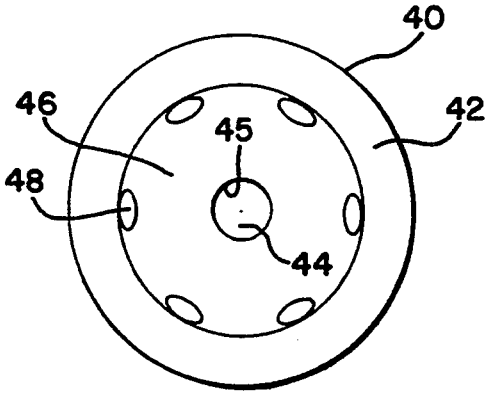
FIG. 6 is a bottom view of a conventional slag stopper chamber as shown in FIG. 2.

Referring to FIG. 4, a tundish vessel is shown which, for the most part, is as described above with respect to FIGS. 1 and 2. A slag stopper assembly includes a slag stopper cheer 40 whose lower lip 42 rests on the floor 20 of the tundish 10 and surrounds the block portion 25 of the drain 24. The chamber 40 has a frustro-conical configuration and further includes, as shown in FIG. 6, a central opening 44, a slanted wall 46 between the central opening 44 and the lower lip 42, and a plurality of openings 48 near the bottom of the slanted wall 46 for receiving molten metal from the tundish vessel at large.

Extending through the center opening 44 of the chamber 40 is the stopper plunger 30 including the elongated plunger piston 32 and the drain stopper 34 having a diameter wider than the diameter of the plunger piston 32, and connected to the lower end of the plunger piston 32. As shown, the drain stopper 34 has a slanted and pointed lower end 35 which is adapted to engage and seal the opening in the drain nozzle 23 so as to terminate the flow of molten metal passing through the drain 24. As shown, the plunger piston 32 is in the extended (drain closing) position.

Figure 9:
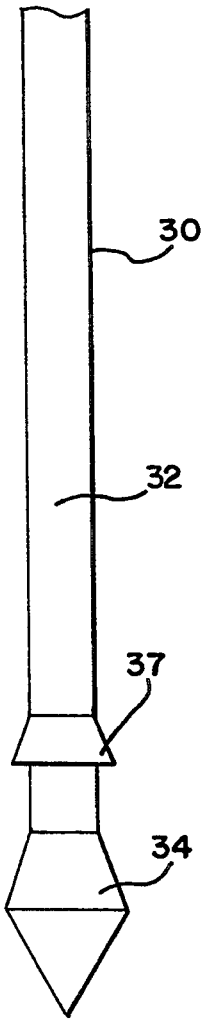
FIG. 9 is a front view of a plunger piston including a sealing rim, as shown in FIG. 4.

The plunger piston 32 can be retracted from the drain by a conventional piston drive assembly (not shown) familiar to persons skilled in the art. In order to limit the amount of retraction, in accordance with the invention, the plunger piston 32 also includes a sealing rim 37 extending around the perimeter of the piston 32 (FIG. 9), at a distance above the drain stopper 34. The sealing rim 37 is adapted to engage the inner surface of the slanted wall 46 when the piston 32 is retracted, preferably allowing just enough retraction to facilitate the free flow of molten metal through the drain 24.

The sealing rim 37 not only limits the movement of the piston 32 but also isolates and seals the center opening 45 in the chamber 40 from suction pressure occurring when the drain is open. Depending somewhat on the configuration of the piston 32 and of the chamber 40, the sealing rim 37 should generally be placed so that the maximum retractive movement of the piston 32 is at least 25 percent less than the maximum retractive movement if no sealing rim were present. Preferably, the sealing rim should be positioned so that the maximum retractive movement of the piston 32 is at least 50 percent less than if no sealing rim were present.

Figure 5:
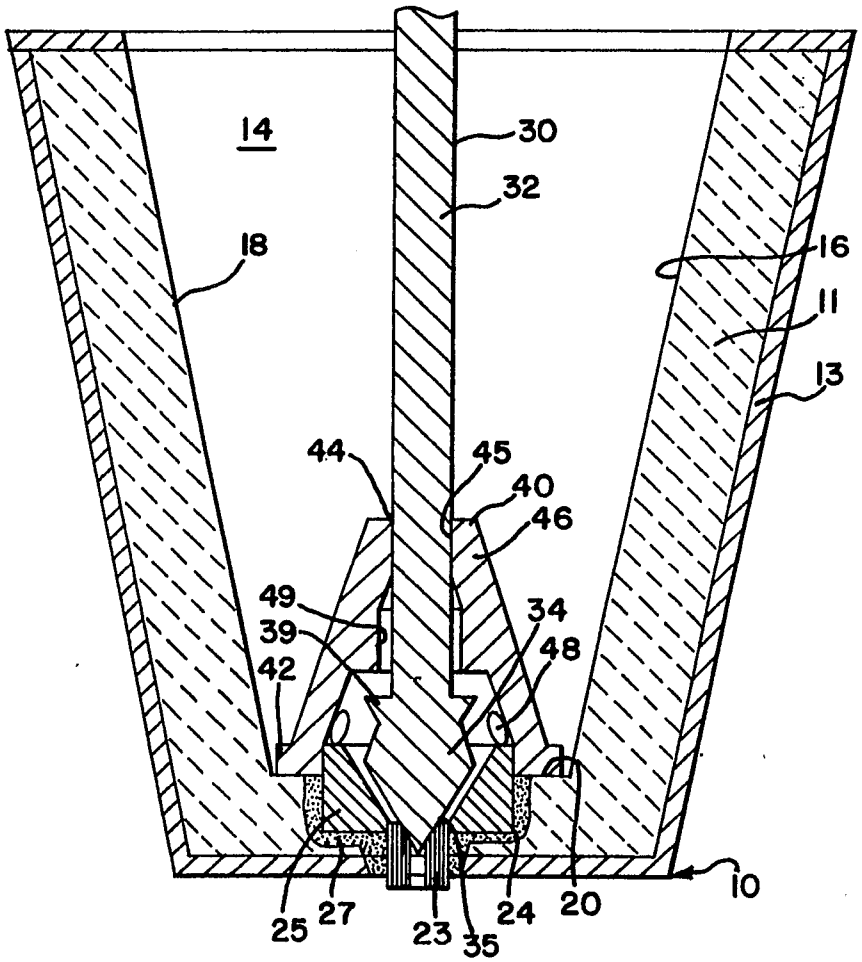
FIG. 5 corresponds to FIG. 2 except that both the slanted wall of the chamber and the plunger piston have been modified to include sealing rims which engage each other when the plunger piston is partially retracted.
Figure 7:
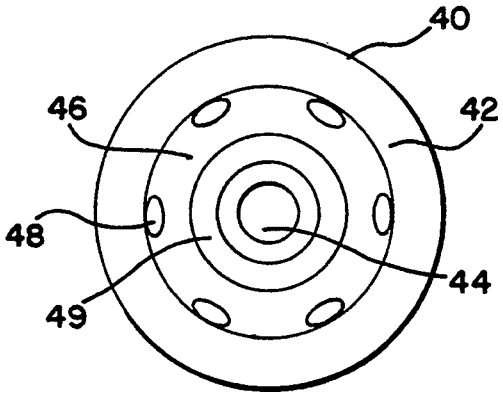
FIG. 7 is a bottom view of a slag stopper chamber including a sealing rim, as shown in FIG. 5.
Figure 8:
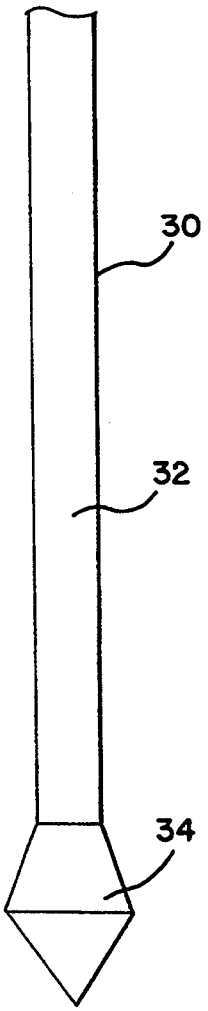
FIG. 8 is a front view of a conventional plunger piston as shown in FIG. 2.
Figure 10:
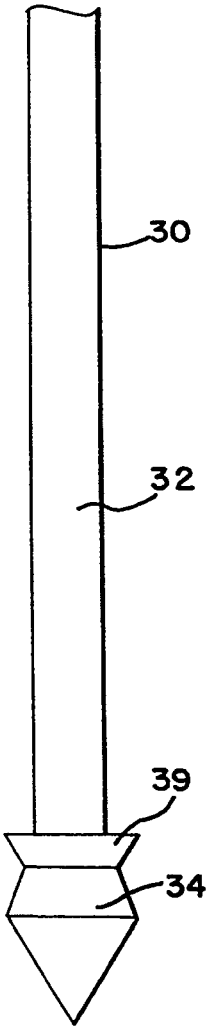
FIG. 10 is a front view of a plunger piston including a sealing rim, as shown in FIG. 5.

The same objectives of limiting the movement of the piston 32 and isolating the center opening 45 from suction, can alternatively be accomplished by placing an appropriate sealing rim on the inner surface of the slanted wall 46 of the chamber 40 (FIG. 7), or by placing cooperating sealing rims on both the piston 32 and the slanted wall 46 (FIG. 5). Referring to FIGS. 5, 7 and 10, the slanted wall 46 of the chamber 40 further includes a sealing rim 49 extending around the inner perimeter of the slanted wall 46. The plunger piston 42 also includes a sealing rim 39 located just above the drain stopper 34. The sealing rim 39 and sealing rim 49 are configured and adapted to engage each other in a sealing relationship when the piston 32 is retracted just enough to permit molten metal to flow freely and unobstructed through the drain 24.

All of the key components of the slag stopper assembly 30, including the plunger piston 32, the drain stopper 34, the rims 37 or 42 and 49, and the chamber 40, can be constructed from a high strength, high temperature resistant, erosion resistant refractory material. Examples of refractory materials include, but are not limited to, aluminas, alumina-silica combinations, refractory clays, and mixtures thereof. The rim or rims may be constructed from the same refractory materials used to make the conventional slag stopper assemblies not having rims.

Figure 11:
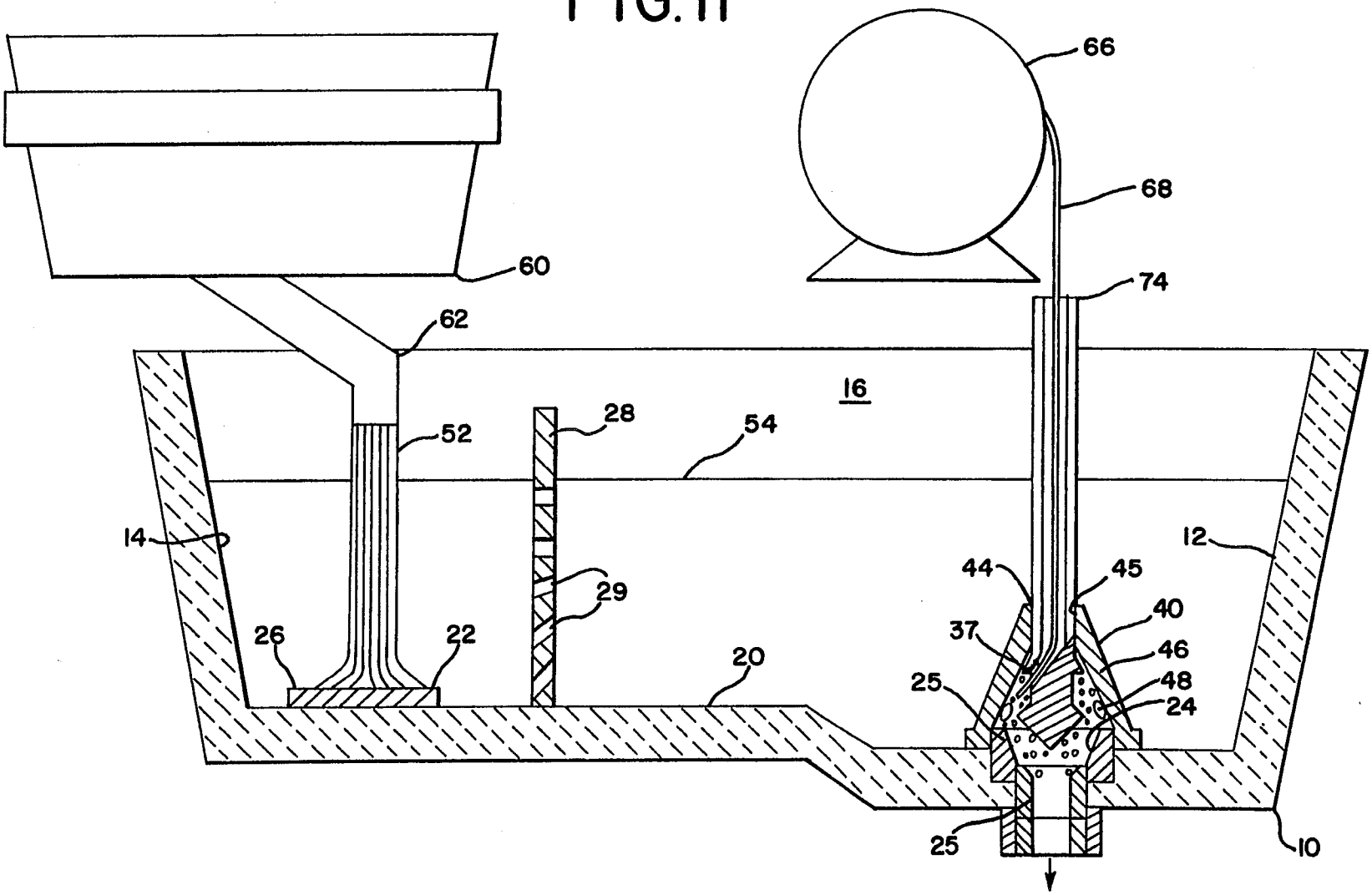
FIG. 11 is a side sectional view of a tundish vessel of the invention in which the slag stopper chamber is also used for alloying, and the plunger piston is designed to accommodate an alloying wire feed.

In the parent U.S. application Ser. No. 08/179,930, which is incorporated herein by reference, an invention is described wherein a chamber similar to the slag stopper chamber above the drain described above, has been converted into an alloying chamber for mixing an alloy feed wire with a base molten steel to form a steel alloy. The invention of the present application can also be adapted to practice the invention of the parent application. Referring to FIG. 11, the tundish 10 is used in combination with a ladle 60 that feeds a base molten metal 52 (e.g. steel) into the tundish at a continuous rate. The ladle 60 has a spout 62 which empties above the impact region 22 of the tundish 10. When the tundish 10 and ladle 60 are at steady state, the level of liquid metal in the tundish is roughly defined by a line 54. At this liquid level, the flow rate of finished metal leaving the tundish through the drain 24 is about the same as the overall flow rate of metal entering the tundish.

The base steel is processed in the tundish 10, i.e., its flow is regulated by the baffle 28 having openings 29 such that alumina inclusions and other impurities rise to the top and the purified base steel approaches the alloying chamber 40, which is above and surrounding the drain 24. The alloying chamber 40 makes it possible to combine the base steel with alloying ingredients to form a steel alloy just before the steel leaves the tundish.

The base steel enters the alloy chamber 40 through the openings 48. Simultaneously, an alloy ingredient wire 68 is fed from a wire feeder 66 located above the tundish 10, through a feed pipe 74 which doubles as the stopper plunger 30 hereinbefore described. The feed pipe 44 extends vertically from above the tundish 10 to the interior of the chamber 40. The wire feeder 66 can be any conventional automated wire feeder known in the art, for example, an automated spool. The details of the wire feeder 66 are not important. However, it is important that the wire feeder 66 be able to feed the wire 68 continuously and at a steady predetermined rate, and that the predetermined rate be adjustable to permit the manufacture of different alloys having different compositions.

The composition of the alloy ingredient wire 68 varies with the specific alloy being produced, and should contain the alloy ingredients in the exact ratios that are to be added to the base steel. For example, if tin is the only alloy being added to the base steel, then the alloy ingredient wire may include tin and no other alloy ingredients. Alternatively, if cobalt, titanium and nickel are to be added to the base steel, in equal amounts, then the alloy ingredient wire should include equal amounts of cobalt, titanium and nickel. Alternatively, a plurality of alloy ingredient wires 68 may be fed simultaneously to the allow chamber 40, with one wire supplying the cobalt, one wire supplying the titanium, and one wire supply the nickel.

Figure 13:
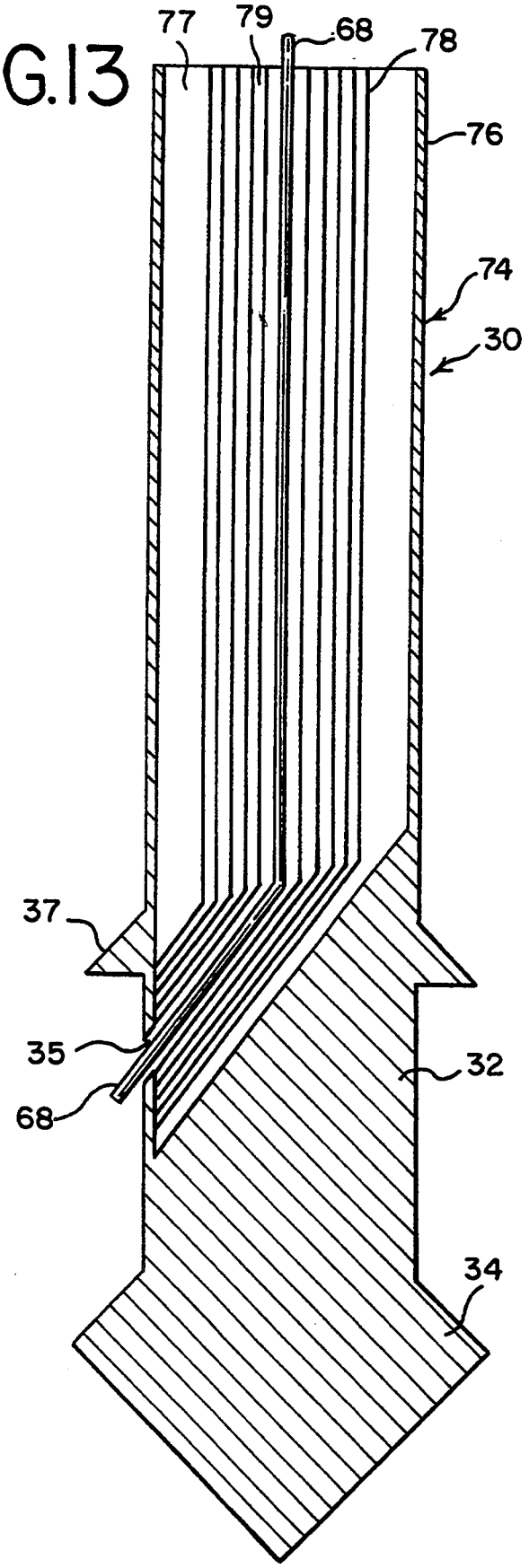
FIG. 13 is an exploded side sectional view of the plunger piston shown in FIG. 11.
Figure 12:
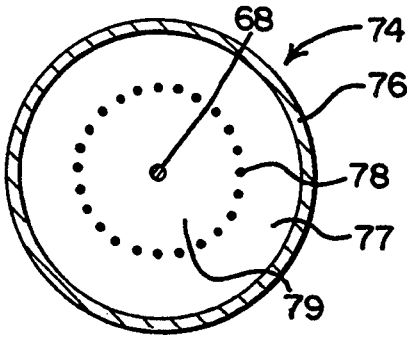
FIG. 12 is an exploded lower sectional view of the plunger piston shown in FIG. 11.

The feed pipe 74 protects the alloy ingredient wire 68 from exposure to the molten base steel while the wire 68 is travelling between the wire feeder 36 and the alloying chamber 40. As shown in FIGS. 12 and 13, the feed pipe 74 includes an outer wall 76 of high temperature-resistant refractory material and an inner mesh or cage portion 78 of permanently mounted wire or screen material. The inner mesh or cage portion 78 defines a feed path 79 through which the alloy ingredient wire 68 may travel, and prevents the wire 68 from straying or touching the outer wall 76. The inner mesh or cage portion 78 and outer wall 76 also define a space 77 therebetween, through which an inert cooling fluid, for example, argon gas, may be injected.

As stated above, the feed pipe 74 also doubles as a stopper plunger 30. As shown in FIG. 13, the feed pipe 74 is formed as a part of the retractable plunger piston 32. Attached to the lower end of the plunger piston 32 is a drain stopper 34 having a diameter wider than the diameter of the piston 32, and having a pointed lower end 35 adapted for sealing off the tundish drain. A sealing rim 37 having a diameter wider than the diameter of the piston 32 is positioned on the piston 32 at a distance above the drain stopper 34. As explained above, the sealing rim 37 limits the movement of the piston 32 when the piston is retracted to open the drain.

Above the sealing rim 37, the feed pipe 74 follows a substantially vertical path through the center of the piston 32. In the vicinity of the sealing rim 37, the feed pipe 74 begins to angle toward the side of the piston 32, and opens into the alloy chamber 40 at a location 35 in the side of the piston 32. As shown, the opening 35 is below the sealing rim 37 and above the drain stopper 34. The opening 35 need only be larger than the diameter of the alloy wire 68. Preferably, the inert cooling fluid enters the space 77 at the top of the feed pipe 74 and exits through the opening 35, at a sufficient velocity to both cool the wire 68 and prevent molten steel from entering the feed pipe 74 through the opening 35.

When the alloy ingredient wire 68 leaves the feed pipe 74 and enters the alloy chamber 40, the wire 68 melts and mixes with the base steel in the alloy chamber to form a finished steel alloy. The feeding speed of the alloy ingredient wire is calculated as an appropriate weight percentage of the steady state flow rate of the molten base steel 52 entering and passing through the tundish 10 and into the alloy chamber 40, to give a steel alloy having the desired composition. Examples of these calculations are given in the parent U.S. application Ser. No. 08/179,930, the disclosure of which has been incorporated herein by reference.

Inside the alloying chamber 40, mixing of the base steel and alloy ingredients can be enhanced by bubbling argon gas or another suitable inert gas up through the drain nozzle 24 and into the alloying chamber 40, using techniques well known in the art. In other words, it is a standard practice in the art to bubble an inert gas up through the tundish drain, to further homogenize the molten metal and to cause any remaining inclusions to rise away from the drain. These same inert gas bubbling techniques can also be employed to facilitate mixing in the alloying chamber 40. Referring to FIG. 11, argon gas may be injected using the inert gas purging nozzle 25 located just below the drain 24.

Other mixing techniques can also be employed to facilitate homogenization of the alloy ingredients with the base steel in the alloying chamber 40. For example, as shown in FIG. 11, an electromagnetic stirrer 27 may be located beneath the drain 24. The swirling action of molten metal caused by the electromagnetic stirrer carries up through the drain 24 and into the alloying chamber 40.

When switching production from one alloy to another, it is entirely unnecessary to disturb the steady state flow of base steel from the ladle and through the tundish, or to lower the level of liquid metal in the tundish. Instead, it is only necessary to change the type of alloying wire or wires originating from the one or more wire feeders 68. The time required to achieve steady state production of a new alloy is substantially reduced compared to prior art techniques, because the volume inside the alloying chamber is much less than the overall volume of the tundish. Accordingly, the amount of steel lost during transition is greatly reduced, and it becomes economically feasible for the steel producer to manufacture small order quantities of steel alloys.

While the embodiments of the invention disclosed herein are presently considered to be preferred, various improvements and modifications can be made without departing from the spirit and scope of the invention. The scope of the invention is indicated in the appended claims, and all changes that fall within the meaning and range of equivalents are intended to be embraced therein.

We claim:

1. A slag stopper assembly for use in a metallurgical vessel, comprising:

a chamber including an inverted conical wall portion with a top and a base, a lip at the base of the wall, a central opening at the top of the wall, and one or more molten metal feed inlets in the wall;

a retractable stopper plunger including an elongated piston passing through the central opening in the chamber and a drain stopper located at a lower end of the elongated piston; and a rim positioned above the drain stopper which limits the maximum retractive movement of the piston to a lesser extent than if no rim was present, by contacting the chamber.

2. The assembly of claim 1, wherein the sealing rim is located on the piston above the drain stopper.

3. The assembly of claim 1, wherein the rim is located on an inner surface of the conical wall portion.

4. The assembly of claim 3, further comprising a second rim located on the piston above the drain stopper.

5. The assembly of claim 1, wherein the rim is positioned such that the maximum retractive movement of the piston is at least about 25 percent less than if no rim was present.

6. The assembly of claim 1, wherein the rim is positioned such that the maximum retractive movement of the piston is at least about 50 percent less than if no rim was present.

7. The assembly of claim 1, wherein the rim is configured to seal off the central opening of the chamber from a portion of the chamber below the sealing rim when the stopper plunger is in a retracted position.

8. The assembly of claim 1, wherein the piston further comprises a feed pipe for feeding a wire into the chamber.

9. The assembly of claim 8, wherein the feed pipe comprises an outer wall, an inner cage defining a feed path for the alloying material, and a space between the outer wall and inner cage for receiving cooling fluid.

10. In a tundish vessel which includes a floor, one or more walls, a region of impact, and at least one drain, the improvement comprising:

a slag stopper assembly including a chamber, a retractable stopper plunger movable relative to the chamber for opening and closing the drain, and a rim positioned above the drain stopper which limits the maximum retractive movement of the stopper plunger to a lesser extent than if no rim was present, by contacting the chamber.

11. The tundish vessel of claim 10, wherein the rim is located on the retractable stopper plunger.

12. The tundish vessel of claim 10, wherein the rim is located on an inner wall of the chamber.

13. The tundish vessel of claim 12, further comprising a second rim located on the retractable stopper plunger.

14. The tundish vessel of claim 10, wherein the retractable stopper plunger penetrates the chamber through a central opening in the chamber.

15. The tundish vessel of claim 14, wherein the rim is configured to seal off the central opening from a lower portion of the chamber when the stopper plunger is in a retracted position.

16. The tundish vessel of claim 10, wherein the rim is positioned such that the maximum retractive movement of the stopper plunger is at least about 25 percent less than if no rim was present.

17. The tundish vessel of claim 10, wherein the rim is positioned such that the maximum retractive movement of the stopper plunger is at least about 50 percent less than if no rim was present.

18. A metallurgical vessel, comprising:

a floor, a front wall, a back wall, a region of impact, and at least one drain; and a slag stopper assembly located above and around the drain including a chamber for reducing the flow of slag to the drain, a stopper plunger penetrating the chamber through a central opening and movable relative to the chamber for regulating the flow of molten metal to the drain, a drain stopper at a lower end of the stopper plunger, and a sealing rim above the drain stopper which limits the movement of the stopper plunger relative to the chamber, by contacting the chamber.

19. The metallurgical vessel of claim 18, wherein the chamber further comprises a plurality of openings for receiving molten metal from the vessel at large.

20. The metallurgical vessel of claim 18, wherein the chamber further comprises the sealing rim.

21. The metallurgical vessel of claim 18, wherein the stopper plunger comprises an elongated piston and the drain stopper is connected to the piston and has a diameter wider than the piston.

22. The metallurgical vessel of claim 21, wherein the stopper plunger further comprises the sealing rim.

23. The metallurgical vessel of claim 22, wherein the chamber further comprises a second sealing rim.

24. The metallurgical vessel of claim 18, wherein the stopper plunger further comprises a passage for feeding an alloy ingredient wire to the chamber.

25. The metallurgical vessel of claim 18, further comprising at least one inlet for bubbling an inert gas into the chamber.

26. The metallurgical vessel of claim 18, further comprising a magnetic stirrer for mixing molten metal in the chamber.

* * * * *